US009562447B2

(12) United States Patent
Sakata et al.

(10) Patent No.: US 9,562,447 B2
(45) Date of Patent: Feb. 7, 2017

(54) VALVE TIMING CONTROL DEVICE

(71) Applicant: AISIN SEIKI KABUSHIKI KAISHA, Kariya-shi, Aichi-ken (JP)

(72) Inventors: Satoshi Sakata, Chiryu (JP); Masaki Kobayashi, Okazaki (JP); Kazuo Ueda, Gamagori (JP); Shohei Masuda, Kariya (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 0 days.

(21) Appl. No.: 14/808,642

(22) Filed: Jul. 24, 2015

(65) Prior Publication Data

US 2016/0024980 A1 Jan. 28, 2016

(30) Foreign Application Priority Data

Jul. 28, 2014 (JP) ..... 2014-153088

(51) Int. Cl.
*F01L 1/34* (2006.01)
*F01L 1/344* (2006.01)

(52) U.S. Cl.
CPC .... *F01L 1/3442* (2013.01); *F01L 2001/34463* (2013.01); *F01L 2001/34473* (2013.01); *F01L 2800/01* (2013.01)

(58) Field of Classification Search
CPC ..... F01L 1/3442; F01L 2001/34463; F01L 2001/34473; F01L 2800/01
USPC ..... 123/90.15, 90.17
See application file for complete search history.

(56) References Cited

U.S. PATENT DOCUMENTS 6,976,460 B2 12/2005 Komazawa et al.
9,021,999 B2 * 5/2015 Yoshimura ..... F01L 1/3442 123/90.15
2003/0196628 A1 10/2003 Smith
2006/0124093 A1 6/2006 Kanada et al.
2014/0083379 A1 3/2014 Yoshimura et al.

FOREIGN PATENT DOCUMENTS

EP 1 672 186 A1 6/2006
JP 2004-257313 A 9/2004

OTHER PUBLICATIONS

European Search Report, issued Feb. 1, 2016, by the European Patent Office, in corresponding European Patent Application No. 15178121.8. (9 pages).

* cited by examiner

*Primary Examiner* — Ching Chang
(74) *Attorney, Agent, or Firm* — Buchanan Ingersoll & Rooney PC

(57) ABSTRACT

A valve timing control device includes: a driving side rotating body rotating in synchronization with a crankshaft of an internal combustion engine (E); a driven side rotating body rotating integrally with a camshaft of the internal combustion engine and capable of rotating relative to the driving side rotating body; a fluid pressure chamber formed by the driving side rotating body and the driven side rotating body; a partition portion arranged in the fluid pressure chamber and partitioned into a retard chamber and an advance chamber an intermediate lock mechanism including a concave portion a lock member; and a phase control unit controlling the supply of a fluid to the retard chamber and the discharge of the fluid from the advance chamber or the supply of the fluid to the advance chamber and the discharge of the fluid from the retard chamber.

8 Claims, 5 Drawing Sheets

VALVE TIMING CONTROL DEVICE

CROSS REFERENCE TO RELATED APPLICATIONS

This application is based on and claims priority under 35 U.S.C. §119 to Japanese Patent Application 2014-153088, filed on Jul. 28, 2014, the entire contents of which are incorporated herein by reference.

TECHNICAL FIELD

This disclosure relates to a valve timing control device that is provided with a driving side rotating body which rotates in synchronization with a crankshaft of an internal combustion engine and a driven side rotating body which rotates integrally with a camshaft of the internal combustion engine and adjusts the ignition timing of the internal combustion engine so that the relative rotational phase of the rotating members changes.

BACKGROUND DISCUSSION

The valve timing control device described above may be provided with a so-called intermediate lock mechanism that fixes the relative rotational phase of the driving side rotating body and the driven side rotating body to an intermediate phase appropriate for the starting of the internal combustion engine when the internal combustion engine is started. For example, the intermediate lock mechanism quickly sets the relative rotational phase of the driving side rotating body and the driven side rotating body to a predetermined intermediate phase when the internal combustion engine is stopped and allows lock members disposed in one of the rotating bodies to project into engagement grooves disposed in the other rotating body so that the relative rotational phase of both of the rotating bodies is fixed.

This state is maintained during the starting of the internal combustion engine. After the internal combustion engine is started, an intermediate lock state is maintained until hydraulic pressure control for the relative rotational phase is reliably performed with a required hydraulic pressure raised. According to the technique disclosed in JP2004-257313A, for example, the engagement grooves have a stepped shape so that a transition to the intermediate lock state can be expedited when, for example, the internal combustion engine is stopped. In this case, the two lock members can be sequentially engaged with the respective engagement grooves and the transition to the intermediate lock state can be expedited.

In the device according to the related art described above, the lock members are configured to be always spring-biased toward the engagement grooves and the escape of the lock members from the engagement grooves based on a centrifugal force resulting from the rotation of the driving side rotating body and the driven side rotating body during the starting of the internal combustion engine is configured not to occur. In a case where a driver suddenly increases the rotation speed after the starting of the internal combustion engine, however, the lock is unexpectedly released due to the generation of a centrifugal force exceeding the biasing force of the spring or an increase in the vibration of the internal combustion engine, which causes the operation state of the internal combustion engine to be disturbed.

In this case, the problem can be addressed when phase retention control is performed in the unlock state. In some cases, however, the required hydraulic pressure has yet to be achieved immediately after the starting of the internal combustion engine or intermediate retention control is not performed well with the viscosity of the hydraulic oil high during, for example, a cold start. In this case, the relative rotational phase is subjected to the lack of uniformity. This phase irregularity is particularly significant in an intermediate lock-type device. As a result, proper exhaust, fuel economy, and output performances are not achieved unless precise advance and retard phase change operations are performed.

SUMMARY

Thus, a need exists for a valve timing control device which is not suspectable to the drawback mentioned above.

An aspect of this disclosure is directed to a valve timing control device including: a driving side rotating body rotating in synchronization with a crankshaft of an internal combustion engine; a driven side rotating body rotating integrally with a camshaft of the internal combustion engine and capable of rotating relative to the driving side rotating body; a fluid pressure chamber formed by the driving side rotating body and the driven side rotating body; a partition portion arranged in the fluid pressure chamber and partitioned into a retard chamber and an advance chamber, the volume of the retard chamber increasing when a fluid flows in so that the relative rotational phase of the driven side rotating body with respect to the driving side rotating body changes into a retard direction and the volume of the advance chamber increasing when a fluid flows in so that the relative rotational phase changes into an advance direction; an intermediate lock mechanism including a concave portion disposed in one of the driving side rotating body and the driven side rotating body and a lock member arranged in a groove disposed in the other rotating member and engaged with the concave portion or separated from the concave portion, the intermediate lock mechanism capable of being switched between a lock state where the relative rotational phase is restrained to an intermediate lock phase between the most advance angle phase and the most retarded angle phase as the lock member is engaged with the concave portion and an unlock state where the restraint is released as the lock member is separated from the concave portion; and a phase control unit controlling the supply of the fluid to the retard chamber and the discharge of the fluid from the advance chamber or the supply of the fluid to the advance chamber and the discharge of the fluid from the retard chamber so that the relative rotational phase changes, in which the phase control unit supplies the fluid to the advance chamber or the retard chamber so that the relative rotational phase changes in the same direction as the direction of an average torque acting on the camshaft when the intermediate lock mechanism is in the lock state and the internal combustion engine is in a driving state.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
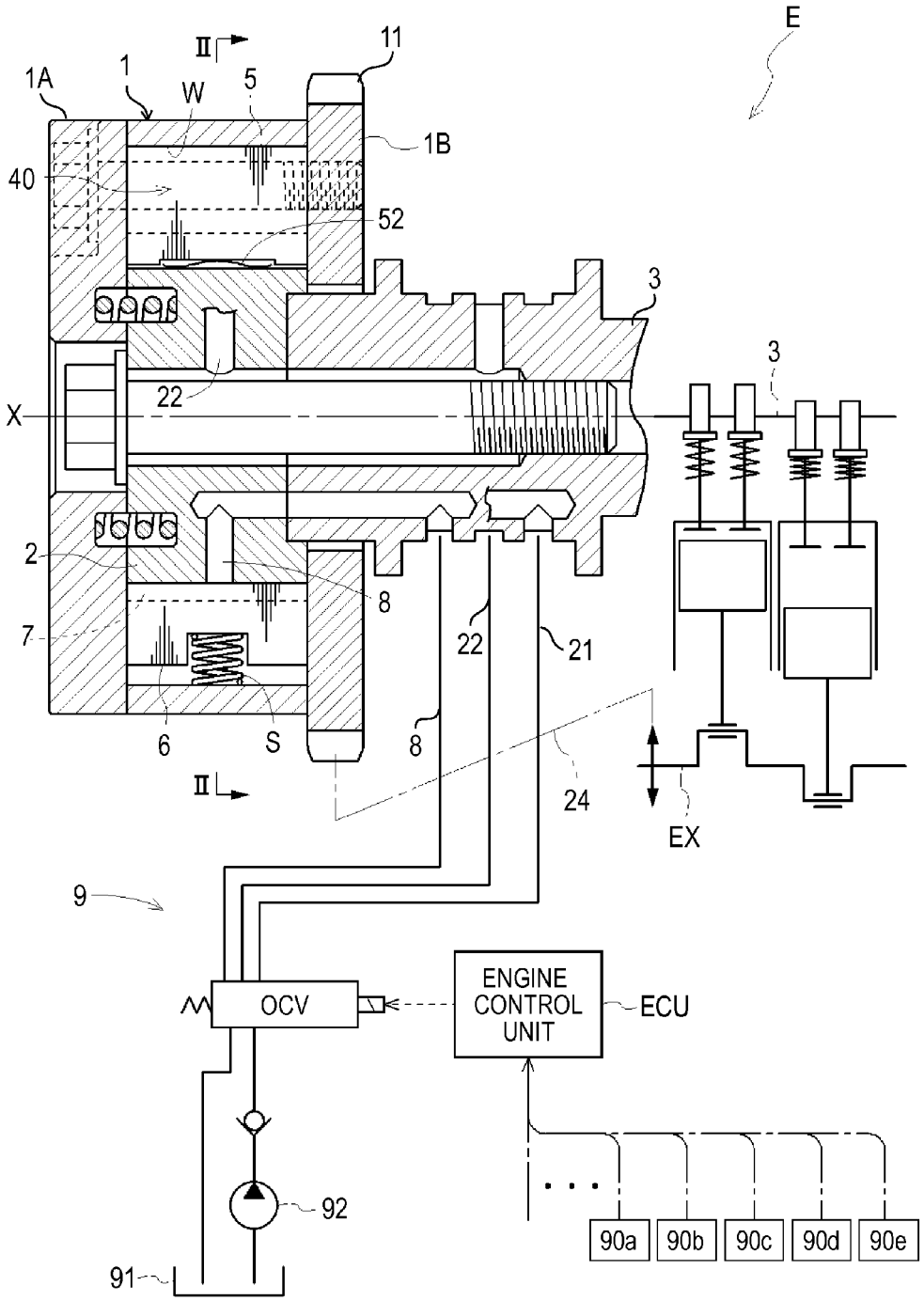
FIG. 1 is a sectional side view illustrating a schematic configuration of a valve timing control device.

Hereinafter, an embodiment of a valve timing control device disclosed here will be described with reference to accompanying drawings.

The valve timing control device according to this embodiment is to ensure that valve timing is set in a state appropriate for starting an internal combustion engine in particular.

The device according to this embodiment has a driving side rotating body 1 that rotates in synchronization with a crankshaft EX of an internal combustion engine E and a driven side rotating body 2 that rotates integrally with a camshaft 3 of the internal combustion engine E and is capable of rotating relative to the driving side rotating body 1. Fluid pressure chambers 40 are formed between the driving side rotating body 1 and the driven side rotating body 2. Retard chambers 41 and advance chambers 42 are formed in the fluid pressure chambers 40. The volume of the retard chambers 41 increases when a fluid flows in so that the relative rotational phase of the driven side rotating body 2 with respect to the driving side rotating body 1 changes into a retard direction S1 and the volume of the advance chambers 42 increases when a fluid flows in so that the relative rotational phase changes into an advance direction S2. The retard chambers 41 and the advance chambers 42 are partitioned from each other by partition portions 5. Concave portions 7 are disposed in one of the driving side rotating body 1 and the driven side rotating body 2 and lock members 6, which are engaged with the concave portions 7 or are separated from the concave portions 7, are disposed in the other one of the driving side rotating body 1 and the driven side rotating body 2.

The lock members 6 extend and retract in, for example, a radial direction with respect to an axis of rotation X along grooves 63 disposed in the driving side rotating body 1. When the lock members 6 are engaged with the concave portions 7, the relative rotational phase of the driving side rotating body 1 and the driven side rotating body 2 is restrained to an intermediate lock phase between the most advanced angle phase and the most retarded angle phase and a lock state is achieved. When the lock members 6 are separated from the concave portions 7, an unlock state is achieved with the restraint released. The lock members 6 are always biased toward the concave portions 7 by biasing members S. A lock oil passage 8, which is used to extrude the lock members 6 from the concave portions 7, is formed in the concave portions 7 and fluid supply and discharge are performed by a control valve OCV. The lock members 6, the biasing members S, the concave portions 7, and the control valve OCV form an intermediate lock mechanism. Switching between the lock state and the unlock state is performed by a control unit ECU. For example, a change in the relative rotational phase of the driving side rotating body 1 and the driven side rotating body 2 is performed by discharging the fluid from the advance chambers 42 while supplying the fluid to the retard chambers 41 or by discharging the fluid from the retard chambers 41 while supplying the fluid to the advance chambers 42.

Usually, the valve timing control device receives a reaction torque based on the biasing force of a valve spring when the camshaft 3 rotates. Accordingly, an average torque acts on the camshaft 3 in the retard direction S1. The device according to this embodiment is provided with a mechanism that prevents an unexpected escape of the lock member 6 from the concave portion 7 during, for example, the starting of the internal combustion engine E such as a case where the intermediate lock mechanism is in the lock state and the internal combustion engine E is in a driving state.

In other words, the control unit ECU is configured to supply the fluid to the advance chambers 42 or the retard chambers 41 so that the relative rotational phase of the driving side rotating body 1 and the driven side rotating body 2 is changed into the same direction as the direction of the average torque acting on the camshaft 3. Specifically, the control unit ECU controls the control valve OCV so that the fluid is supplied to the retard chambers 41 when the internal combustion engine E is started. Then, tip sides of the lock members 6, that is, the tip parts engaged with the concave portions 7 receive an external force in the retard direction S1 and the lock members 6 are retained in a shear state by the driving side rotating body 1 and the driven side rotating body 2 with the base end sides of the lock members 6 seated in the grooves 63 resisting the external force. Accordingly, even in a case where a driver performs an operation causing a sudden increase in rotation speed during the starting of the internal combustion engine E, the lock members 6 are reliably retained in the shear state and the unexpected escape from the concave portions 7 is prevented.

Various types of control valves can be used as the control valve OCV, examples of which may include a control valve that performs only advance and retard control and a control valve that has an engagement and separation control function for the lock members 6 in addition to the advance and retard control function.

The average torque that acts on the camshaft 3 is not limited to an average torque acting on the retard side as described above. In the case of a device that is provided with a spring which biases the camshaft 3 in the advance direction, for example, the average torque acting on the camshaft 3 may act in the advance direction S2. In this case, the direction of initial biasing hydraulic pressure application by the control unit ECU is set to the advance side.

The valve timing control device according to this embodiment may be applied only to an intake side valve device and an exhaust side device or can be widely applied insofar as the intermediate lock mechanism is provided. Particularly effective examples include a case where the intermediate lock mechanism is provided in the intake side device in the internal combustion engine E that can be operated in a Miller cycle region or an Atkinson region.

In the Miller-cycle internal combustion engine E, the intake valve is closed at a crank angle of approximately 90 to 110 degrees after the passage of a piston through a bottom dead center. In the operation aspects, compression begins after the discharge of some of suctioned air, and thus the actual compression ratio is lowered. Accordingly, ignitability worsens at, for example, a low temperature and it is difficult to cold-start the internal combustion engine E in some cases. Accordingly, a reliable starting of the internal combustion engine E using the intermediate lock mechanism is required, and thus the application of what is disclosed here is particularly useful in the case of an internal combustion engine operated in the Miller cycle or the Atkinson cycle.

The valve timing control device according to this embodiment can also be used for an exhaust side valve. In this case, the state of exhaust gas can be improved and the discharge of hydrocarbon (HC) or the like can be prevented when the combustion state of the internal combustion engine E is stabilized with an intermediate lock state maintained. A specific example of this device is as follows.

The driving side rotating body 1 and the driven side rotating body 2 are provided as illustrated in FIG. 1. The driving side rotating body 1 is driven by a timing chain and a timing belt 24 receiving a driving force from the crankshaft EX and the driven side rotating body 2 rotates integrally with the camshaft 3 which is coaxially arranged with respect to the driving side rotating body 1.

The driving side rotating body 1 is externally mounted to be capable of rotating relative to the driven side rotating body 2 within a predetermined angular range. A sprocket 11 is disposed on the outer periphery of the driving side rotating body 1.

Figure 2:
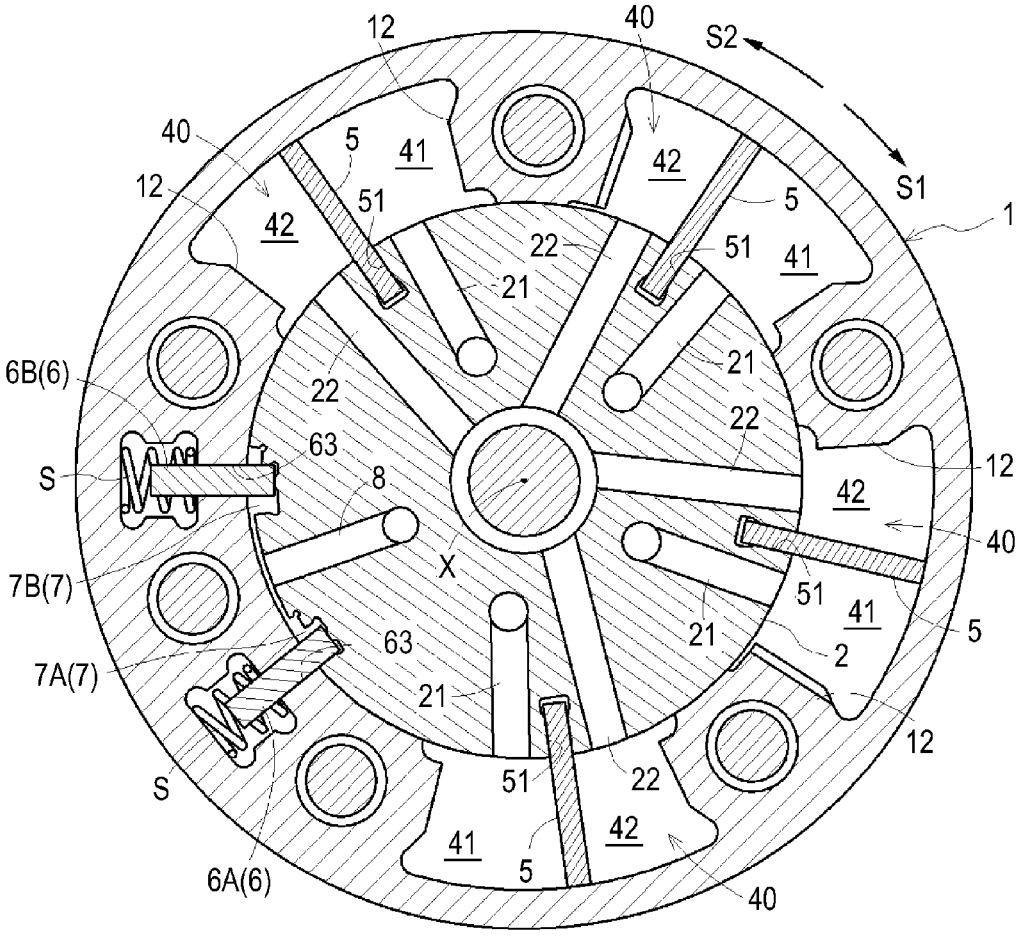
FIG. 2 is an elevational sectional view of a valve timing control mechanism in a lock state.

FIG. 2 is an explanatory functional diagram partially using the outline of the cross-section taken II-II line in FIG. 1.

As illustrated in FIG. 2, a plurality of projecting portions 12 that protrude radially inward are disposed, side by side and apart from each other in the direction of rotation, in the driving side rotating body 1. The fluid pressure chambers 40, which are defined by the driving side rotating body 1 and the driven side rotating body 2, are formed between the respective projecting portions 12 and 12 adjacent to each other in the driving side rotating body 1.

Vane grooves 51 are formed at places in the outer peripheral portion of the driven side rotating body 2 facing the respective fluid pressure chambers 40. Vanes 5, which partition the fluid pressure chambers 40 into the advance chambers 42 and the retard chambers 41 in the relative rotation direction (arrow S1 and S2 directions in FIG. 2), are slidably inserted into the vane grooves 51 in the radiation direction. As illustrated in FIG. 1, the vanes 5 are biased to inner wall surface w sides of the fluid pressure chambers 40 by springs 52 provided on the inner diameter sides of the vanes 5.

The advance chambers 42 communicate with advance passages 22 formed in the driven side rotating body 2. The retard chambers 41 communicate with retard passages 21 formed in the driven side rotating body 2. The advance passages 22 and the retard passages 21 are connected to a hydraulic circuit 9 (described later).

Rotation Phase Restraining Mechanism

The intermediate lock mechanism, which restrains the relative rotation of the driving side rotating body 1 and the driven side rotating body 2 when the relative rotational phase is the intermediate lock phase (phase illustrated in FIGS. 2 and 3) between the most advanced angle phase and the most retarded angle phase, is provided between the driving side rotating body 1 and the driven side rotating body 2. The intermediate lock mechanism is provided with a pair of combinations of the lock members 6 and the concave portions 7. The concave portions 7 are configured to be stepped so that the lock members 6 are sequentially engaged with the concave portions 7.

Figure 3:
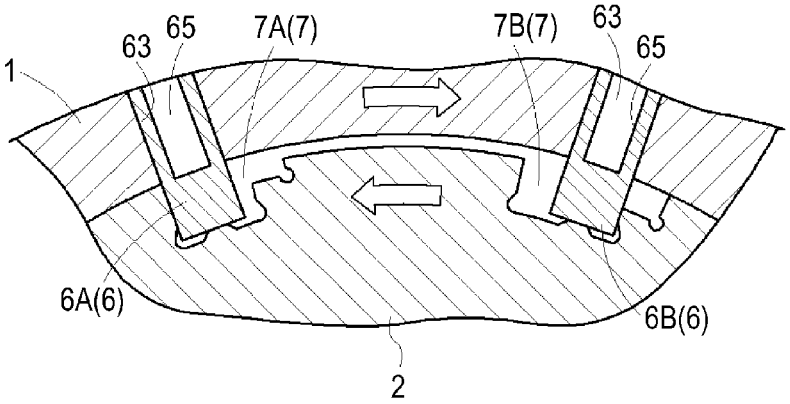
FIG. 3 is a diagram illustrating a lock state of an intermediate lock mechanism.

As illustrated in FIGS. 2 and 3, both a first lock member 6A and a second lock member 6B project into a first concave portion 7A and a second concave portion 7B in the lock state, respectively. The first lock member 6A is regulated by the deep wall portion of the first concave portion 7A that is on the left side in FIG. 3 and the second lock member 6B is regulated by the shallow wall portion of the second concave portion 7B that is on the right side in FIG. 3. Stepped portions disposed in the first concave portion 7A and the second concave portion 7B are ratchet structures that allow the sequential engagement of the first lock member 6A and the second lock member 6B during the relative retard-side rotation of the driven side rotating body 2 by the reaction torque of the camshaft 3 occurring when, for example, the internal combustion engine E is stopped. A guide path 73, which lowers the height of the outer surface of the driven side rotating body 2 by one step, is disposed between the first concave portion 7A and the second concave portion 7B. Accordingly, the first lock member 6A or the second lock member 6B can be reliably held between the first concave portion 7A and the second concave portion 7B during a lock operation and a transition to the lock state can be expedited.

As illustrated in FIGS. 1 and 2, the hydraulic circuit 9 supplies oil, which is a working fluid, to one or both of the retard chambers 41 and the advance chambers 42 via the retard passages 21 and the advance passages 22. Then, the relative positions of the vanes 5 change in the fluid pressure chambers 40 and the relative rotational phase of the driving side rotating body 1 and the driven side rotating body 2 changes. The control valve OCV illustrated in FIG. 1 is configured to perform not only the adjustment of the relative rotational phase but also the supply of the oil to the first lock concave portion 7 and the second lock concave portion 7. A reciprocating spool SP is provided in the control valve OCV, and the position of the spool SP is adjusted based on electric power supply amount control by the control unit ECU. In this manner, a plurality of ports are opened or closed and oil supply and discharge to and from the lock oil passage 8 communicating with the first concave portion 7A and the second concave portion 7B as well as the retard passages 21 or the advance passages 22 are performed.

The hydraulic circuit 9 is provided with an oil pan 91 that stores the oil and a pump 92 that is driven electrically or by the driving force of the internal combustion engine E and supplies the oil toward the control valve OCV.

A memory storing a predetermined program or the like, a CPU, an I/O interface, and the like are built into the control unit ECU. As illustrated in FIG. 1, detection signals from a cam angle sensor 90*a* that detects the phase of the camshaft 3, a crank angle sensor 90*b* that detects the phase of the crankshaft, an oil temperature sensor 90*c* that detects the temperature of the oil, a rotation speed sensor 90*d* that detects the rotation speed of the crankshaft, an IG key switch 90*e*, and various sensors such as a vehicle speed sensor, a coolant temperature sensor, and a throttle opening degree sensor are input into the control unit ECU. The control unit ECU can obtain the relative rotational phase of the camshaft 3 and the crankshaft EX, that is, the relative rotational phase of the driving side rotating body 1 and the driven side rotating body 2 of the valve timing control device from the phase of the camshaft 3 detected by the cam angle sensor 90*a* and the phase of the crankshaft EX detected by the crank angle sensor 90*b*.

The control unit ECU is configured to adjust the amount of the electric power supply to the control valve OCV by the hydraulic circuit 9 based on the operation states of the internal combustion engine E such as the oil temperature in the internal combustion engine E, the rotation speed of the crankshaft EX, the vehicle speed, and the throttle opening degree and control the relative rotational phase of the driving side rotating body 1 and the driven side rotating body 2 to a phase appropriate for the operation states.

When the IG key switch 90*e* is turned ON during the starting of the internal combustion engine E in particular, the control unit ECU puts the spool into operation before the ignition of a spark plug and operates the control valve OCV into a state where the oil is supplied to the retard chambers 41. In addition, no oil is supplied to the lock oil passage 8 and a state is maintained where the first lock member 6A and the second lock member 6B are engaged with the first concave portion 7A and the second concave portion 7B.

An oil pump is driven with the rotation of the crankshaft EX and the oil is immediately supplied to the retard chambers 41. Then, the driven side rotating body 2 is pressed against the retard side and is combined with the reaction torque from the camshaft 3 so that the second lock member 6B is shear-retained by the driven side rotating body 2 and the driving side rotating body 1 as illustrated in FIG. 3.

Figure 4:
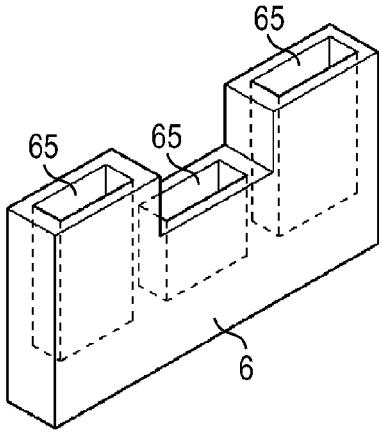
FIG. 4 is a perspective view illustrating the appearance of a lock member.

As illustrated in FIGS. 3 and 4, the first lock member 6A and the second lock member 6B according to this embodiment have thinned portions 65 disposed therein for weight reduction. Herein, hole portions are formed toward tip portions from end surfaces on the base end portion sides of the first lock member 6A and the second lock member 6B. More specifically, the parts of the first lock member 6A and the second lock member 6B protruding from the grooves 63 when the intermediate lock mechanism is in the lock state are formed to be solid and the thinned portions 65 are formed only at the parts accommodated in the grooves 63.

According to this configuration, the first lock member 6A and the second lock member 6B can be reduced in weight. Accordingly, the centrifugal force acting during the starting of the internal combustion engine E can be decreased and the sudden escape of the lock members 6 can be prevented. In the case of unlocking, the reduction in weight allows a quick operation of both the lock members 6 even in a case where hydraulic pressure for the operation is not sufficiently high during the cold or the like.

Especially, the outer shapes of the first lock member 6A and the second lock member 6B do not change since the hole portions are formed as the thinned portions 65, and thus the pressure-receiving area of the tip surface on which the oil pressure acts during the unlocking does not decrease. Accordingly, release control for the lock members 6 can be expedited.

Since the thinned portions 65 are formed at the parts of the first lock member 6A and the second lock member 6B accommodated in the grooves 63, the wall thickness of the part bearing a shear force is ensured even in a case where the shear force acts on the first lock member 6A and the second lock member 6B in the intermediate lock state. Accordingly, inconvenience such as a deformation of the first lock member 6A and the second lock member 6B during the starting of the internal combustion engine E does not occur and the intermediate lock mechanism can achieve a high level of reliability.

The first lock member 6A and the second lock member 6B are produced by, for example, a metal injection molding (MIM) method. In this production method, an injection mold is formed in a predetermined shape, and thus various shapes are available as, for example, the internal shapes of the thinned portions 65.

Another Embodiment of Thinned Portion

Figure 5:
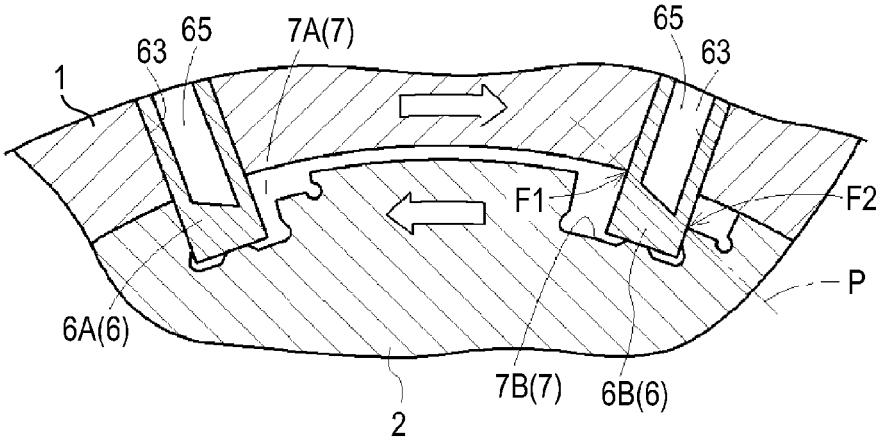
FIG. 5 is a diagram illustrating a lock state of an intermediate lock mechanism according to another embodiment.
Figure 6:
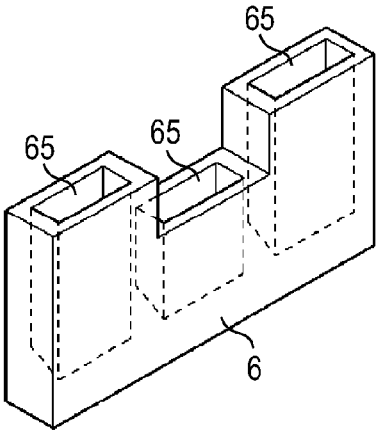
FIG. 6 is a perspective view illustrating the appearance of a lock member according to another embodiment.

In a case where the grooves 63 of the lock members 6 and the concave portion 7 are away from each other in the radial direction, a plane P through a part F1 on the base end side abutting against the open end portion of the grooves 63 and a part F2 on the tip side of the second lock member 6B abutting against the open end portion on the bottom side of the second concave portion 7B is set regarding, for example, the second lock member 6B as illustrated in FIGS. 5 and 6 when the intermediate lock mechanism is in the lock state and the thinned portions 65 are formed further toward the grooves 63 than to the plane P in the second lock member 6B.

This configuration allows the strength of the second lock member 6B to withstand the shear force. In this case, the thinned portions 65 can also be formed at the positions in the second lock member 6B protruding from the grooves 63, and thus the weight of the lock members 6 is further reduced. As a result, the unexpected escape of the lock members 6 due to the centrifugal force can be more effectively prevented and the operation of the lock members 6 can be accelerated.

Another Embodiment of Lock Member

Figure 7:
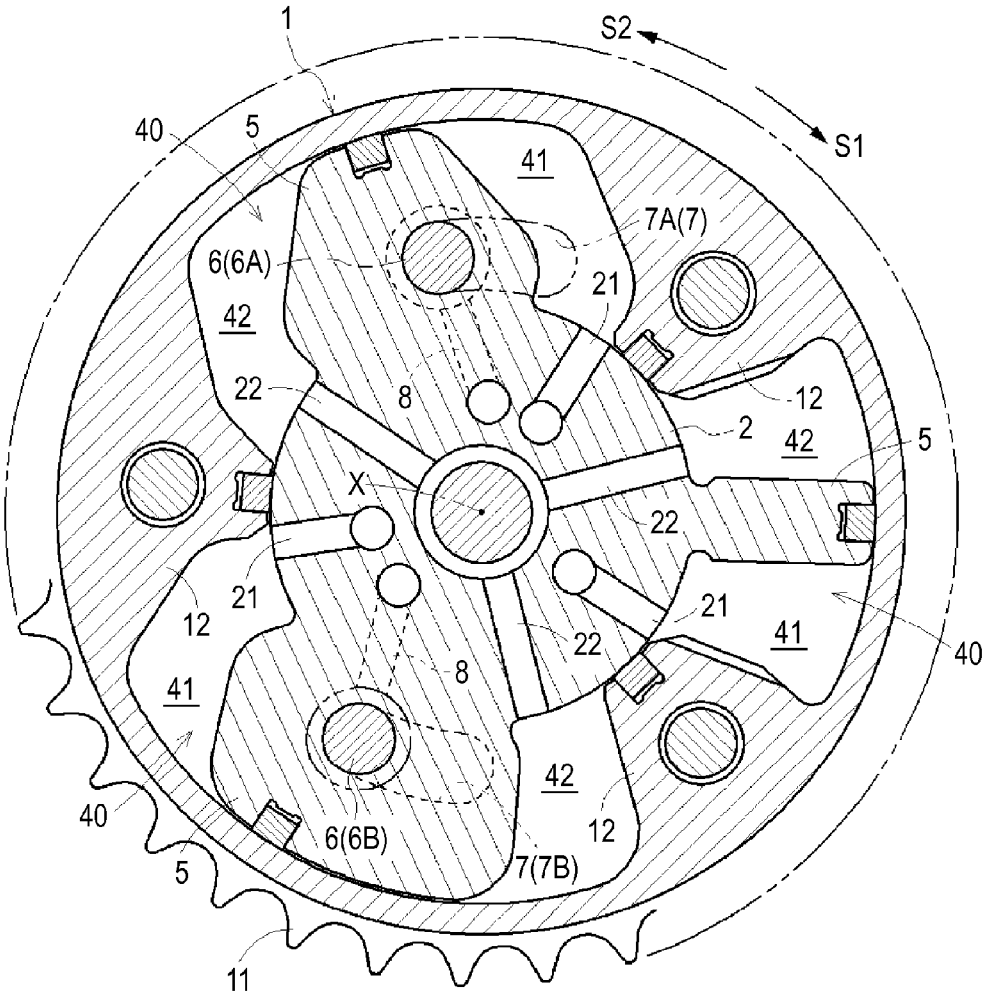
FIG. 7 is a sectional side view illustrating a schematic configuration of a valve timing control device according to another embodiment.
Figure 8:
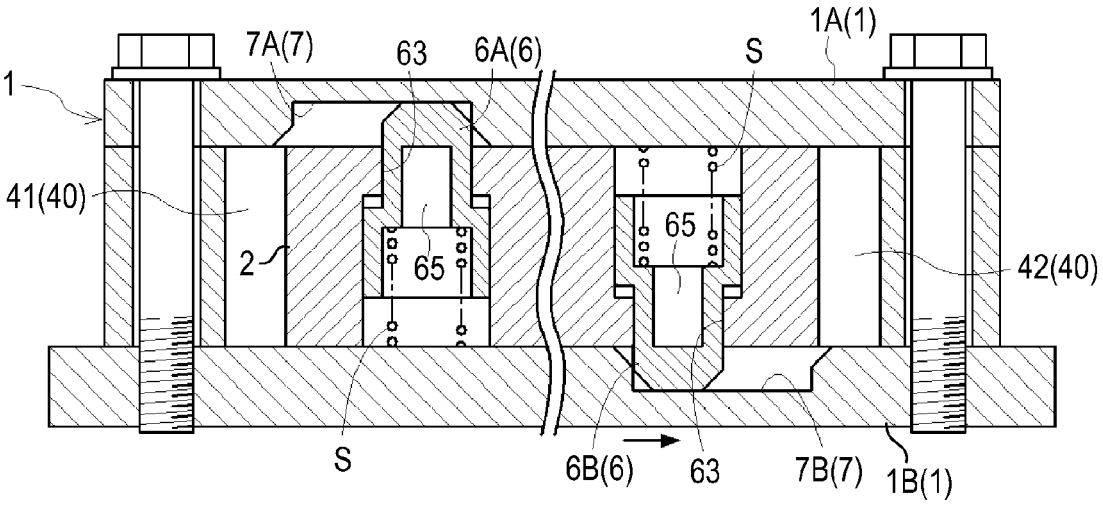
FIG. 8 is a diagram illustrating a lock state of an intermediate lock mechanism according to another embodiment.

The lock members 6 disclosed here are also applicable in a case where the engagement and separation direction of the lock members 6 is parallel to the axis of rotation X of the camshaft 3 as illustrated in FIGS. 7 and 8. In the case of this type of valve timing control device, no centrifugal force acts on the first lock member 6A and the second lock member 6B immediately after the starting of the internal combustion engine. However, vibration during the starting of the internal combustion engine, riding of a chamfered portion formed in the tip portion of the lock member on a chamfered portion disposed in the opening portion of the concave portion for lock, and the like may cause the first lock member 6A or the second lock member 6B to be unlocked by escaping the lock state. Accordingly, even in the case of this configuration, hydraulic pressure control is performed during the starting of the internal combustion engine so that the driven side rotating body 2 relatively rotates in the direction in which the average torque received by the camshaft 3 acts.

The first lock member 6A and the second lock member 6B are formed to be divided respectively into the plurality of partition portions 5 constituting the driven side rotating body 2. The first concave portion 7A engaged with the first lock member 6A is disposed in a front plate 1A constituting the driving side rotating body 1 and the second concave portion 7B engaged with the second lock member 6B is disposed in a rear plate 1B of the driving side rotating body 1. Each of the first lock member 6A and the second lock member 6B is biased in the engagement direction by the biasing members S. The lock oil passage 8 is formed to communicate with each of the first concave portion 7A and the second concave portion 7B.

As illustrated in FIG. 8, the thinned portions 65 are also formed in the first lock member 6A and the second lock member 6B. Herein, no step is formed in the first concave portion 7A and the second concave portion 7B and the thinned portions 65 are formed only at the parts positioned in the grooves 63 as illustrated in FIG. 8.

An aspect of this disclosure is directed to a valve timing control device including: a driving side rotating body rotating in synchronization with a crankshaft of an internal combustion engine; a driven side rotating body rotating integrally with a camshaft of the internal combustion engine and capable of rotating relative to the driving side rotating body; a fluid pressure chamber formed by the driving side rotating body and the driven side rotating body; a partition portion arranged in the fluid pressure chamber and partitioned into a retard chamber and an advance chamber, the volume of the retard chamber increasing when a fluid flows in so that the relative rotational phase of the driven side rotating body with respect to the driving side rotating body changes into a retard direction and the volume of the advance chamber increasing when a fluid flows in so that the relative rotational phase changes into an advance direction; an intermediate lock mechanism including a concave portion disposed in one of the driving side rotating body and the driven side rotating body and a lock member arranged in a groove disposed in the other rotating member and engaged with the concave portion or separated from the concave portion, the intermediate lock mechanism capable of being switched between a lock state where the relative rotational phase is restrained to an intermediate lock phase between the most advance angle phase and the most retarded angle phase as the lock member is engaged with the concave portion and an unlock state where the restraint is released as the lock member is separated from the concave portion; and a phase control unit controlling the supply of the fluid to the retard chamber and the discharge of the fluid from the advance chamber or the supply of the fluid to the advance chamber and the discharge of the fluid from the retard chamber so that the relative rotational phase changes, in which the phase control unit supplies the fluid to the advance chamber or the retard chamber so that the relative rotational phase changes in the same direction as the direction of an average torque acting on the camshaft when the intermediate lock mechanism is in the lock state and the internal combustion engine is in a driving state.

According to this configuration, not only the average torque acting on the camshaft but also fluid pressure are allowed to act so that the relative rotational phase of the driving side rotating body and the driven side rotating body changes in the direction in which the average torque acts and a shear force as well as the average torque acting on the camshaft is allowed to act on the lock members by the concave portion disposed in one of the driving side rotating body and the driven side rotating body and the groove disposed in the other one of the driving side rotating body and the driven side rotating body. Accordingly, the lock members can have a very high shear retention effect and the intermediate lock state can be reliably retained even in a situation in which a centrifugal force exceeding the force causing the lock member to be engaged with the concave portion acts on the lock member.

In the valve timing control device, a part of the lock member protruding from the groove when the intermediate lock mechanism is in the lock state may be formed to be solid and a thinned portion may be formed at a part of the lock member accommodated in the groove.

The weight of the lock member can be reduced when the thinned portion is formed in the lock member as in this characteristic configuration. Accordingly, the centrifugal force that acts immediately after the starting of the internal combustion engine, for example, decreases and the sudden escape of the lock member can be prevented.

Since the lock member is reduced in weight, an operation for unlocking the lock member can be expedited and a rapid change in ignition timing is allowed even in a case where an increase in fluid pressure for operation is delayed as in the case of, for example, a cold start of the internal combustion engine.

Since the thinned portion is formed at the part of the lock member accommodated in the groove, the wall thickness of the part bearing a shear force can be ensured even in a case where the shear force acts on the lock member in the intermediate lock state. Accordingly, inconvenience such as a deformation of the lock member does not occur during the starting of the internal combustion engine and the intermediate lock mechanism can achieve a high level of reliability.

In the valve timing control device, a plane through a part of the lock member abutting against an open end portion of the groove and a part of the lock member abutting against an open end portion of the concave portion when the intermediate lock mechanism is in the lock state may be set and the thinned portion may be formed from a part of the lock member accommodated in the groove to a part reaching the plane.

The shear force acts on the position of the open end portion of the groove and the position of the open end portion of the engagement groove with regard to the lock member in the intermediate lock state. In a case where the engagement groove is provided with a ratchet mechanism formed into a stepped shape and is shaped to facilitate the transition to the intermediate lock state, for example, the positions on which the shear force acts when the intermediate lock state is achieved are the positions separated in the engagement and separation direction of the lock member. When the thinned portion is formed toward the groove rather than the plane connecting both of the acting positions, that is, the base end side of the lock member in this case, the strength of the lock member can withstand the shear force. In this case, the thinned portion can also be formed at the position of the lock member protruding from the groove and the weight of the lock member can be further reduced. As a result, the unexpected escape of the lock member due to the centrifugal force can be prevented and a rapid unlock operation can be performed.

The valve timing control device disclosed here can be in wide use, not limited to the intake valve side device or the exhaust valve side device, insofar as the valve timing control device has the intermediate lock mechanism.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve timing control device comprising:

a driving side rotating body rotating in synchronization with a crankshaft of an internal combustion engine;

a driven side rotating body rotating integrally with a camshaft of the internal combustion engine and rotatable relative to the driving side rotating body, the camshaft on which an average torque acts in a state where the camshaft rotates integrally with the driven side rotating body;

a fluid pressure chamber formed by the driving side rotating body and the driven side rotating body;

a partition portion arranged in the fluid pressure chamber and partitioned into a retard chamber and an advance chamber, the volume of the retard chamber increasing when a fluid flows in so that a relative rotational phase of the driven side rotating body with respect to the driving side rotating body changes into a retard direction and the volume of the advance chamber increasing when a fluid flows in so that the relative rotational phase changes into an advance direction;

a concave portion disposed in one of the driving side rotating body and the driven side rotating body and a lock member arranged in a groove disposed in the other rotating member and engaged with the concave portion or separated from the concave portion, the relative rotational phase being switchable between a lock state where the relative rotational phase is retained to an intermediate lock phase between a most advance angle phase and a most retarded angle phase as the lock member is engaged with the concave portion and an unlock state where the retained intermediate lock phase is released as the lock member is separated from the concave portion; and a phase control unit controlling the supply of the fluid to the retard chamber and the discharge of the fluid from the advance chamber or the supply of the fluid to the advance chamber and the discharge of the fluid from the retard chamber so that the relative rotational phase changes, wherein the relative rotational phase changes in a same direction as a direction of the average torque acting on the camshaft by the supply of the fluid to the advance chamber or the retard chamber by the phase control unit when the relative rotational phase is in the lock state and the internal combustion engine a driving state.

2. The valve timing control device according to claim 1, wherein a part of the lock member protruding from the groove when the relative rotational phase is in the lock state is formed to be solid and a thinned portion is formed at a part of the lock member accommodated in the groove.

3. The valve timing control device according to claim 2, wherein the lock member is disposed radially outward of the concave portion when separated from the concave portion.

4. The valve timing control device according to claim 2, wherein a plane through a part of the lock member abutting against an open end portion of the groove and a part of the lock member abutting against an open end portion of the concave portion when the relative rotational phase is in the lock state is set and the thinned portion is formed from a part of the lock member accommodated in the groove to a part reaching the plane.

5. The valve timing control device according to claim 4, wherein the lock member is disposed radially outward of the concave portion when separated from the concave portion.

6. The valve timing control device according to claim 1, wherein a plane through a part of the lock member abutting against an open end portion of the groove and a part of the lock member abutting against an open end portion of the concave portion when the relative rotational phase is in the lock state is set and a thinned portion is formed from a part of the lock member accommodated in the groove to a part reaching the plane.

7. The valve timing control device according to claim 6, wherein the lock member is disposed radially outward of the concave portion when separated from the concave portion.

8. The valve timing control device according to claim 1, wherein the lock member is disposed radially outward of the concave portion when separated from the concave portion.

* * * * *